US009610002B2

(12) United States Patent
Classen et al.

(10) Patent No.: US 9,610,002 B2
(45) Date of Patent: Apr. 4, 2017

(54) CARTRIDGE FOR A WATER-CONDUCTING DOMESTIC APPLIANCE COMPRISING A DETERGENT DOSING SYSTEM

(71) Applicant: BSH Bosch und Siemens Hausgeräte GmbH, Munich (DE)

(72) Inventors: Egbert Classen, Stahnsdorf (DE); Helmut Jerg, Giengen (DE)

(73) Assignee: BSH Hausgeräte GmbH, Munich (DE)

( * ) Notice: Subject to any disclaimer, the term of this patent is extended or adjusted under 35 U.S.C. 154(b) by 1003 days.

(21) Appl. No.: 13/746,342

(22) Filed: Jan. 22, 2013

(65) Prior Publication Data

US 2013/0133700 A1 May 30, 2013

Related U.S. Application Data

(63) Continuation of application No. 12/311,043, filed as application No. PCT/EP2007/058987 on Aug. 29, 2007, now Pat. No. 8,382,913.

(30) Foreign Application Priority Data

Sep. 19, 2006 (DE) ..... 10 2006 043 913

(51) Int. Cl.
*A47L 15/44* (2006.01)
*D06F 39/02* (2006.01)

(52) U.S. Cl.
CPC ..... *A47L 15/449* (2013.01); *A47L 15/4454* (2013.01); *A47L 15/4463* (2013.01); *A47L 15/4472* (2013.01); *D06F 39/022* (2013.01)

(58) Field of Classification Search
CPC ..... A47L 15/4454; A47L 15/4463; A47L 15/449; A47L 15/4472; D06F 39/022
See application file for complete search history.

(56) References Cited

U.S. PATENT DOCUMENTS 5,113,199 A 5/1992 Chan et al.
6,345,889 B1 2/2002 Sakuraoka et al.
2002/0088502 A1 7/2002 Van Rompuy et al.
(Continued)

FOREIGN PATENT DOCUMENTS

DE 1938198 U 5/1966
DE WO 2005058126 A1 * 6/2005 ..... A47L 15/4418
(Continued)

OTHER PUBLICATIONS

International Search Report PCT/EP2007/058987 dated Dec. 12, 2007.
(Continued)

*Primary Examiner* — Alexander Markoff
(74) *Attorney, Agent, or Firm* — Michael E. Tschupp; Andre Pallapies

(57) ABSTRACT

A cartridge for a water-conducting domestic appliance, in particular a domestic dishwasher, which has a detergent dosing system having at least one detergent dispenser for receiving at least one cartridge, wherein the cartridge has separate chambers for storing at least two detergents, the cartridge including a cartridge housing having at least two chambers formed therein, wherein each chamber has a storage capacity for storing detergent which is greater than the quantities required for one washing cycle.

6 Claims, 3 Drawing Sheets

(56) References Cited

U.S. PATENT DOCUMENTS

| | | | | |
|---|---|---|---|---|
| 2005/0126608 | A1 | 6/2005 | DeWeerd et al. | |
| 2006/0059958 | A1 | 3/2006 | Byrne et al. | |
| 2007/0144558 | A1* | 6/2007 | Classen ..... | A47L 15/4418<br>134/18 |
| 2009/0044575 | A1 | 2/2009 | Brandt et al. | |

FOREIGN PATENT DOCUMENTS

| | | | |
|---|---|---|---|
| GB | 2417492 | A | 3/2006 |
| WO | 0220893 | A1 | 3/2002 |

OTHER PUBLICATIONS

Report of Examination DE 10 2006 043 913.9-15 dated Mar. 16, 2007.

* cited by examiner

CARTRIDGE FOR A WATER-CONDUCTING DOMESTIC APPLIANCE COMPRISING A DETERGENT DOSING SYSTEM

CROSS-REFERENCE TO RELATED APPLICATIONS

This application is a continuation, under 35 U.S.C. §120, of U.S. application Ser. No. 12/311,043, filed Mar. 17, 2009, now U.S. Pat. No. 8,382,913, which is a U.S. national stage application under 35 U.S.C. §371 of PCT/EP2007/058987, filed Aug. 29, 2007, which designated the United States; this application also claims the priority, under 35 U.S.C. §119, to German Application No. 10 2006 043 913.9, filed Sep. 19, 2006.

BACKGROUND OF THE INVENTION

The majority of domestic dishwashers currently in use have an adding device for receiving one or more detergent(s) which are added to the washing water during the course of a washing cycle to clean the items for washing that are shelved in the dishwasher. All of the detergent held in the adding device is conventionally dispensed into the washing compartment during the washing cycle and mixed into the washing water circulated therein. In terms of its size, the adding device is dimensioned such that the precise quantity of detergents required for a washing cycle can be poured in. At the start of each washing cycle the user of the dishwasher is therefore required to pour into the adding device the quantity of detergent needed for the washing cycle. This operation is not convenient for the user of the dishwasher. Furthermore, with dishwashers of this kind there is the problem of the quantity of detergents poured into the adding device potentially varying from user to user and also from washing cycle to washing cycle. An incorrectly dosed quantity of detergent can lead to unsatisfactory wash results on the one hand—if an inadequate dose of detergents has been added, and lead to wasting of detergents, and environmental pollution therefore, on the other hand—if an excessive quantity of detergents has been added.

Moreover, adding devices, which add the quantity of detergents stored therein to the washing water in one go, do not allow more complex washing programs to be carried out. Thus for example in certain situations it may be expedient to add the detergent to the washing water at different times. Adding devices, which are designed to receive a single detergent dose, cannot support such complex washing cycles.

BRIEF SUMMARY OF THE INVENTION

The object of the invention is to provide a cartridge for a water-conducting domestic appliance with a detergent dosing system, with which the aforementioned disadvantages can be overcome.

A cartridge according to the invention for a water-conducting domestic appliance, in particular a domestic dishwasher, has a detergent dosing system which has at least one detergent dispenser for receiving at least one cartridge, the cartridge having separate chambers for storing at least two detergents. The invention is characterized in that each chamber has a storage capacity for storing detergent which is greater than the quantity required for one washing cycle. During a washing cycle, the detergent dosing system for receiving the cartridge essentially provides precisely the quantity of detergent which is required for one washing cycle. Detergents can be combinations of cleaning agent components or individual cleaning agent substances, such as an enzyme for example. The detergents can be in a liquid form or also a gel form. A plurality of detergents can be arranged in chambers of the cartridge. Provision can however also be made such that the detergent dosing system is designed for receiving an appropriate number of cartridges having only one chamber. The storage of different detergents in different chambers has the advantage that in a particular step of a washing cycle only the detergent which is actually required for this washing step needs to be added. It is naturally possible that during a particular step of a washing cycle a plurality of the detergents can also be added simultaneously. Inasmuch as two detergents different from one another are basically added simultaneously to the washing water during a washing cycle, it is also possible to arrange these detergents in a common chamber of the cartridge.

By preference, provision is made for the cartridge to have chambers for storing more than 2 and less than 10, preferably 7, detergents. This makes it possible to forego storing combinations of cleaning agent components and instead to store individual cleaning substances, such as alkaline solutions, bleaching agents, complexing agents and also enzymes and to add these as required. In this situation, the selective addition of complexing agents for example makes it possible to regulate the water hardness such that a dishwasher can be designed without a water softening facility. The regulation of the water hardness can take place under sensor control or manually through an operator. In addition, an adjustment of the added substances to suit the length of a selected cleaning program can take place.

According to one embodiment, the volume of the chambers is dimensioned such that between 20 and 40, preferably 30, washing cycles can be performed as the total number z of washing cycles.

According to a further embodiment, the respective chambers are arranged in a common housing of the cartridge, from which results a particularly simple handling operation for the user.

According to a further embodiment, a ventilation chamber is provided in the cartridge according to the invention, which is operatively connected with the chambers containing the detergents. In this situation, the ventilation chamber is connected with the chambers containing the detergents by way of ventilation channels in a common cover covering the individual chambers. This serves to ensure that no vacuum can become established in the chambers as the latter become increasingly empty, as a result of which the addition of detergents to the washing water would become more difficult or may not occur in the correct quantity. In this case the ventilation chamber is preferably part of the cartridge.

A further embodiment provides for the fact that the cartridge is provided with at least one openable closure which can be opened, in particular automatically, on insertion into the detergent dosing system and can be closed, in particular automatically, on removal of the cartridge from the detergent dosing system. The openable closure can be formed for example by a membrane. During storage and transportation the closure serves to prevent the detergent stored in the cartridge from accidentally spilling out. Opening of the closure takes place at that moment at which the cartridge is inserted into the detergent dispenser of the detergent dosing system such that an addition of detergent to the washing water is possible during further operation of the dishwasher. The number of closures can vary, depending on the construction of the cartridge. Expediently, a number of closures corresponding to the number of chambers in the cartridge is provided. The number of closures can also correspond to the number of detergents in the cartridge. The openable closure can be arranged for example in the downward direction of gravity, in other words at the base of the cartridge, when the cartridge is situated in the installation position in the detergent dosing system. The complete emptying of the cartridge through the delivery device is facilitated by this means, as a result of which no detergent remains unused in the cartridge.

A further embodiment makes provision for the cartridge to have at least one delivery device, by means of which the at least two detergents can be delivered into the washing compartment of the dishwasher. This procedural method has the advantage that the detergent dispenser of the detergent dosing system according to the invention can be configured particularly simply in its construction. According to this embodiment, the devices necessary for dosing the detergents contained in the cartridge into the washing compartment are contained exclusively in the cartridge. In this situation, provision can be made such that a number of delivery devices corresponding to the number of detergents or chambers are provided.

In one variant, the delivery of the at least two detergents takes place by way of the force of gravity and in a further variant by means of defining an outflow time during which the at least two detergents can be delivered from the cartridge by way of the openable closure for further processing. In this variant, the openable closure of the cartridge is necessarily arranged below in the direction of gravity when the cartridge is situated in its installation position in the detergent dosing system.

To prevent incorrect insertion of the cartridge into a detergent dispenser of the detergent dosing system, the housing of the cartridge has a mechanical coding, a lug for example, which corresponds with a matching depression in the detergent dosing system. The coding is configured in such a way that the cartridge may only be inserted in one way—the intended way—into the detergent dispenser.

The cartridge can have any suitable form. By preference however, provision is made such that the housing of the cartridge has a longitudinal side along a main axis. In this situation, the base body in question can for example have a rectangular shape with a longitudinal axis, along the width for example, which is considerably longer than all the other axes (along the depth and the height). The base body in question can however also have a conical, truncated conical, cylindrical, pyramidal or truncated pyramidal shape with a main axis.

In this situation it is preferable for the main axis to be longer than secondary axes of the housing with one of the aforementioned basic shapes of the cartridge, by a factor of at least 1.5 for example. Furthermore, the base body can preferably have one extension along a first secondary axis, along the height for example, and one extension along a second secondary axis, along the depth for example, the extension along the first secondary axis being considerably longer than the extension along the second secondary axis, by a factor of 5 to 10 for example, preferably 5. Especially good handling of the cartridge and an expedient volume for the respective detergents result when the housing of the cartridge has a rectangular basic shape having a depth of about 25 mm, a width of about 200 mm and a height of about 125 mm. In particular, the preferred total number z of washing cycles between 20 and 40, preferably 30, can be implemented with such dimensions.

In one preferred development, provision is made for the chambers of the cartridge to be arranged beside one another along the main axis. In other words, in the case of a cartridge having a rectangular basic shape and a main axis extending in the direction of the width, the division into chambers results in chamber dimensions whereby the dimension of one chamber is a proportion of the width corresponding to the number of chambers, while an equal depth and height is given for all chambers.

According to a further embodiment, at least one section of the cartridge facing the washing compartment of the dishwasher when the cartridge is located in the detergent dosing system has thermal insulation which limits a heat flow from the washing compartment in the direction of the detergent dosing system. The long-term stability of the detergents stored in the cartridge is advantageously ensured as a result of this course of action. This allows the use of detergents that contain temperature-sensitive substances. The thermal insulation prevents or limits excessively strong temperature variations in the detergent stored in the cartridge. This procedural method is advantageous in particular in the situation when the quantity of detergent stored is designed for a very large total number of washing cycles.

The thermal insulation in the section of the cartridge facing the washing compartment of the dishwasher can be formed by a gas volume arranged in the section. It is possible to manufacture the housing body from a plastic by using the gas injection molding process (GID) known from the prior art, in which a gas-filled cavity is embedded into the section manufactured from an injectable material, such as plastic. The insulation can also be formed by means of a solid or liquid insulating material arranged in the section. This insulating material can be present in addition to the material comprising the housing section of the cartridge. The housing section can also be formed by the insulating material. Combinations of the aforementioned materials are also conceivable.

The cartridge according to the invention can furthermore have a means for measuring the level of the detergent volume contained in the cartridge. In one variant, the means for level measurement can be designed to emit a signal when the detergent contained in the cartridge has been completely used up. This serves as a signal to the user of the dishwasher that it is necessary to replace the cartridge for correct operation of the dishwasher in preparation for the next washing cycle. In a different variant, the means for level measurement is designed to emit a signal when the detergent contained in the cartridge is sufficient for performing a predefined number m of washing cycles. In this situation the number m of washing cycles can in principle be chosen at will, whereby m is preferably chosen between 2 and 5. By this means, a future need to replace the cartridge is indicated to the user of the dishwasher. The user is however still in a position to use the dishwasher for a certain number of washing cycles, with the result that time still remains in order to procure a new cartridge.

In one embodiment, provision is made for the means for level measurement to be arranged in only one of the chambers of the cartridge for determining the fill level of the detergent in this chamber. The information about the fill level of a single one of the chambers is sufficient in order to deduce the fill level of the entire cartridge because the volume of the detergents in the respective chambers is dimensioned such that each of the detergents in the chambers is used up by the z-th washing cycle and in each washing operation an equal percentage proportion of the at least two detergents is dosed by the dosing system. With a low requirement in terms of monitoring facilities, this procedural method permits a precise prediction of the fill level of respective detergents in the cartridge.

The means for level measurement can be based on optical, acoustic or capacitive principles of measurement.

Furthermore, provision is preferably made for at least one of the chambers to contain at least one of the following ingredients: alkali carriers, for example alkaline solution, complexing agents and dispersants; for example polymers; enzymes such as amylase, protease or lipase; bleaching agents, for example hydrogen peroxide; bleaching activators, and surfactants, such as non-ionic surfactants. The chambers can also hold a biocidal liquid. In particular they can hold biocides against bacteria (bactericides), against fungi (fungicides), against microorganisms (microbicides), against viruses (virucides) and against algae (algicides), of which the addition prevents unpleasant smells from forming by for example biofilm formation during relatively long service lives.

BRIEF DESCRIPTION OF THE DRAWINGS

The invention will be described in detail in the following with reference to the figures. In the drawings.

DETAILED DESCRIPTION OF EXEMPLARY EMBODIMENTS OF THE PRESENT INVENTION

Figure 1:
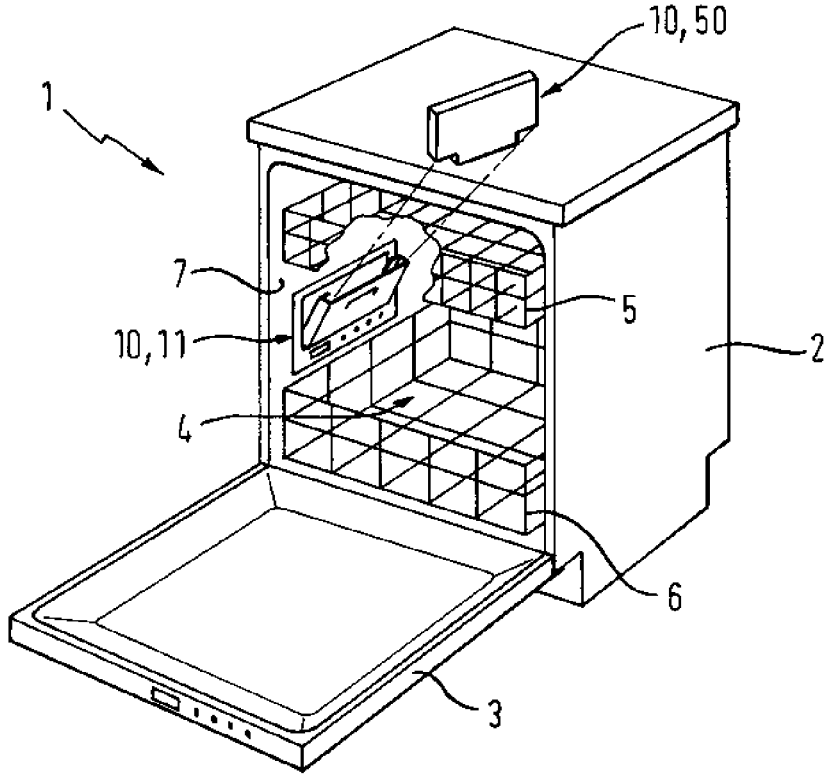
FIG. 1 shows a dishwasher with a detergent dosing system for receiving a cartridge according to the invention, which is arranged in a container wall.

FIG. 1 shows a dishwasher 1 comprising a door 3 pivotably mounted on a housing 2. The figure shows the door 3 in its open position. Crockery racks 5, 6 are arranged in a known manner in a washing compartment 4 that can be closed by the door 3. A detergent dosing system 10, comprising a detergent dispenser 11 and a cartridge 50 according to the invention, which contains at least two detergents that are held separately from each other, is arranged in a container wall 7 of the housing 2. FIG. 1 shows the preferred arrangement of the detergent dosing system 10 between the top rack 5 and the bottom rack 6. The detergent dispenser 11 that receives the cartridge 50 is arranged in a section of the container wall 7 that is located close to the door opening in order to facilitate introduction and removal of the cartridge 50 into or from the detergent dispenser 11 for the user.

The detergent dispenser 11 comprises a housing 12 and a cover which is pivotably mounted with respect to the housing 12. When the cover is in its open position (cf. illustration in FIG. 1), then the cartridge 50 can be inserted into the cover from the washing compartment 4. The cover has, for example, two symmetrically arranged retaining plates for retention and fixing purposes which have an L-shaped design and are matched to the size of the cartridge 50 such that the retaining plates encompass and retain the cartridge 50 after it has been inserted. In addition, a supporting surface is formed on the cover such that the cartridge 50 comes to rest in a defined position (not shown). When the cover is closed, the cartridge is brought into a receiving space in the detergent dispenser 11 and pushed into its final position by means of projections and/or lugs which may be present on the housing of the detergent dispenser.

Figure 3:
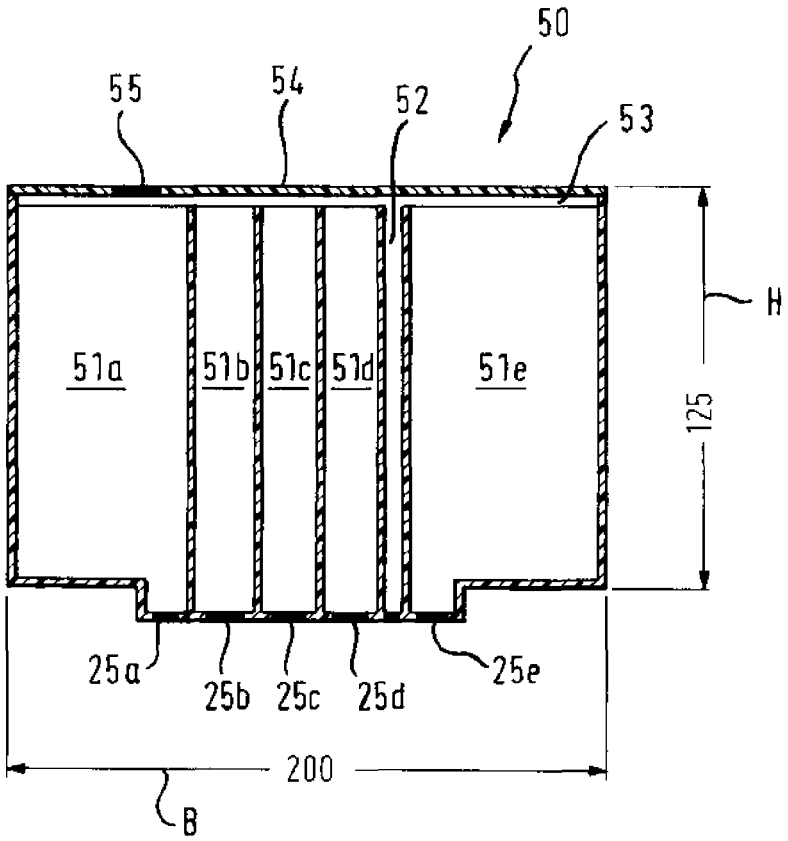
FIG. 3 shows an exemplary embodiment of a cartridge according to the invention for use in the detergent dosing system.

An exemplary embodiment of the cartridge 50 according to the invention is illustrated in FIG. 3. The cartridge 50 simply has five chambers 51*a*, 51*b*, 51*c*, 51*d* and 51*e*, by way of example, for receiving a detergent or a detergent mixture in each case. In this situation, the size of the individual chambers 51*a* to 51*e* is dimensioned according to the volume required during a predefined number of washing cycles. The volume of the different detergents in the chambers 51*a* to 51*e* is dimensioned in such a manner that after a particular number of washing cycles, preferably between 20 and 40, by further preference approx. 30, all of the chambers 51*a* to 51*e* are completely emptied.

The total number of washing cycles involved in exhausting the cartridge depends on the type of the washing cycles performed in each case. In order to satisfy the different requirements, for each program which can be selected in the dishwasher a particular dosage quantity is predefined, or determined by means of a sensing system. In the case of a lightly soiled washing load a smaller dosage quantity is chosen, whereas a higher dosage quantity of detergents is provided for a heavily soiled washing load. In order to ensure that each of the detergents is used up by the same washing cycle, the percentage proportion of each detergent component which is added to the washing water during a washing cycle is equal. This enables economical usage of the available resources since the cartridge is only replaced when it has been completely emptied. Furthermore, this procedural method also makes sensing of the fill level simpler because it is sufficient to sense the fill level in only one of the chambers of the cartridge in order to obtain information about the fill status of the entire cartridge.

Each of the chambers 51*a* to 51*e* is provided with an openable closure 25*a* to 25*e*, taking the form of a membrane for example. The membranes, consisting of rubber for example, give a sealed closure for the individual chambers 51*a* to 51*e* such that no detergent can escape from the cartridge 50 during storage and transportation thereof. When the cartridge 50 is inserted into the detergent dispenser 11, the membranes are punctured by cannulas 21 arranged correspondingly in the detergent dispenser 11 (cf. FIG. 4), such that detergent can be added to the washing compartment in accordance with an appropriate dosing device.

The cartridge is preferably manufactured from a plastic and has a width B of approx. 200 mm, a height H of approx. 125 mm and a depth of approx. 25 mm. With these dimensions, the volume of the different chambers can be dimensioned such that the desired 20 to 40 washing cycles can be performed by means of one cartridge.

In addition to the chambers 51*a* to 51*e*, the cartridge 50 has a further chamber 52 which is connected with one or more ventilation channels 53. The ventilation channel or channels 53 for their part have a connection with the different chambers 51*a* to 51*e*. This serves to ensure that as the chambers 51*a* to 51*e* become increasingly emptied no vacuum can build up therein, on account of which the addition of detergents would be rendered more difficult or falsified. The ventilation channels 53 are preferably situated in a cover 54 which is fitted on the housing of the cartridge after the individual chambers 51*a* to 51*e* have been filled with the respective detergents. The cover 54 can have an overpressure valve 55 which may be necessary in the case of certain detergent components.

Since the detergents contained in the cartridge 50 are only added to the washing compartment, or more precisely to the washing water agitated in the washing compartment, little by little in the course of a plurality of washing cycles, said detergents are subjected to considerable absolute temperatures and temperature variations with each washing cycle. In order to prevent the properties of the detergents from changing with time as a result thereof, at least one housing wall of the cartridge 50 facing the washing compartment and/or the cover of the detergent dosing system 10 facing the washing compartment is/are manufactured from an insulating material or surrounded by insulation. This serves to limit a heat flow from the washing compartment in the direction of the detergent dosing system or the detergents stored in the cartridge, with the result that the long-term stability of the detergents used is ensured. The insulation can be formed by a gas volume arranged in the cover or the relevant housing section of the cartridge. This gas volume constituting the insulation can be incorporated during the course of manufacture of the cover or of the cartridge. The method used here is known as the gas injection molding process (GID).

In addition to the receiving area for the cartridge, the detergent dispenser 11 can have a further chamber for receiving a solid detergent. With regard to the solid detergent, this can for example be a 3-in-1 tablet which is inserted into the further chamber when the receiving space contains no, or an empty, cartridge 50. The provision of the further chamber for receiving a solid detergent makes it possible to use the dishwasher even when the cartridge 50 is empty and no filled cartridge is available.

The further chamber can have an opening which is connected to the ambient environment of the dishwasher. For this purpose, the opening can be connected with the ambient environment by way of channels running on the back of the container wall. The detergent dosing system thus integrates the functionality of a so-called "expansion opening" which serves to dissipate the overpressure occurring in the washing compartment if the dishwasher is, for example, opened and closed again by the user during a washing cycle with already heated washing water. The overpressure occurring at this moment can then be dissipated by way of the further chamber and the opening to the ambient environment.

The detergent dosing system can have means for interrogating the fill level of the detergents in the cartridge in order to detect an empty or almost empty cartridge. When the detergent in one or more of the chambers of the cartridge reaches a predefined fill level, for example when a predefined number of washing cycles is still possible, then this can be indicated to the user by way of an optical signal. The display device can be situated in a known manner, for example on the outside of the door, on the faceplate for example.

The interrogation of the fill level can be performed in an optical, capacitive or acoustic manner.

With regard to an optical interrogation, a light guide can be incorporated in the cartridge, into which light guide is incoupled light by way of a light source present in the detergent dispenser, for example. A light receiver, which is coupled with the light guide and which for example is likewise arranged in the detergent dispenser, receives the light outcoupled from the light guide. An evaluation system coupled with the light source and the light receiver can ascertain the fill level or when a predefined fill level is reached in the cartridge on the basis of the incoupled and outcoupled light quantity.

With regard to a capacitive interrogation, the detergent present in the cartridge can be used as an electrode. A further electrode, manufactured from an electrically conducting material, can be arranged on the detergent dispenser or on the outside wall of the cartridge. The housing material of the cartridge and, where applicable, further housing material of the detergent dispenser and/or an air gap formed between them form a dielectric between the two electrodes. By evaluating the voltage present between these two electrodes, it is possible to deduce the fill level of the detergents in the cartridge.

It is likewise possible to determine the fill level by using an acoustic principle. In this case, a generator provided on the detergent dispenser for example causes the detergent in the cartridge to oscillate. The noises arising during this process can be captured, by means of a microphone for example, and evaluated. The fill level of the detergents in the cartridge can be deduced on the basis of the noise spectrum.

Alternatively, a counter can be used for counting the washing cycles already performed with a full cartridge. In order to enable recognition of a new cartridge, this can be provided with a transponder which can be read out by the dishwasher or the detergent dispenser. Alternatively, a different code, a bar code for example, can be affixed to the cartridge. Reading of the code can take place, for example, on inserting the cartridge into the detergent dispenser.

It is sufficient if the means for level measurement is provided in only one of the chambers of the cartridge. Regardless of this possibility, any of the chambers can naturally be equipped with a separate means for level measurement.

Figure 4:
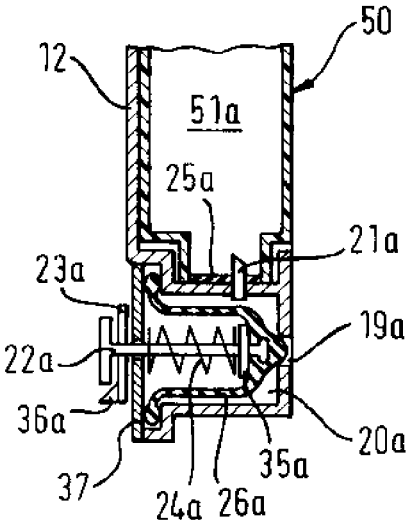
FIG. 4 shows a section through a detergent dosing system, whereby a delivery device arranged in a dosing chamber is illustrated, with which detergent can be delivered from the cartridge according to the invention to the washing compartment of the dishwasher.

Outlets 19*a* to 19*e* are provided in the housing 12 of the detergent dispenser 11 (cf. FIG. 4). The outlets 19*a* to 19*e* open in each case into a dosing chamber 20*a* to 20*e*, whereby only the dosing chamber 20*a* can be seen in the sectional drawing shown in FIG. 4. The dosing chamber 20*a* is connected with the chamber 51*a* of the cartridge by way of the channels 21*a*.

In each of the dosing chambers 20*a* to 20*e* is arranged a delivery device which in the present exemplary embodiment consists of a seal 26*a* mounted so it can move in the dosing chamber 20*a* and a drive mechanism for the seal 26*a*. The seal 26*a* is formed in such a manner that it can move between a position closing the associated outlet (19*a* in the figure) and a position unblocking the outlet. To this end, the seal 26*a* is connected to a valve lifter 22*a*. A movement of the valve lifter 22*a* is effected by a valve actuating lever 23*a*, on which is formed a tapered lug 36*a*. By means of a rotary motion of the valve actuating lever 23*a* the lug strikes the plate of the valve lifter 22*a* and causes a lift. When the valve actuating lever 23*a* is actuated, the seal 26*a* is withdrawn away from the outlet 19*a*. When the valve actuating lever 23*a* is returned to its initial position (by means of a rotary motion in the opposite direction), a restoring force is built up by a spring 24*a*, tensioned between a housing cover 37 and a support 35*a* provided on the valve lifter 22*a*, which positions the seal 26*a* intimately on the outlet 19*a*.

When the seal 26*a* is in its open position, then the detergent contained in the chamber 51*a* can enter the washing compartment through the cannula 21*a* into the dosing chamber 20 and by way of the outlet 19*a* as a result of gravity or an active delivery device, such as a pump for example.

In order to ensure that the same volume is added to the washing water regardless of the fill level of the respective detergents in the cartridge, the outflow time during which the detergents can be delivered from the cartridge for further processing by opening the openable closure is varied depending on the number of the washing cycle just performed since the insertion of a new, full cartridge. The outflow time of the detergents is determined according to the formula $$t_n = x + (n-1) \cdot y$$

where t is the outflow time of the detergent or detergents, n is the number of the washing cycle, x is the outflow time of the detergent or detergents for the first washing operation, and y is a constant.

As the number of the washing operation increases, the outflow time of the detergent or detergents is thus extended so that allowance is made for the reduction in pressure as the volume of detergent in the cartridge decreases.

In this situation, the delivery of the detergent can take place exclusively by utilizing gravity. The delivery device, in particular the design of the seal, can however also be constructed on the principle of a pump, such that detergents are delivered from the cleaning chamber 21*a* into the dosing chamber 20*a* and from the dosing chamber 20*a* into the washing compartment.

Figure 2:
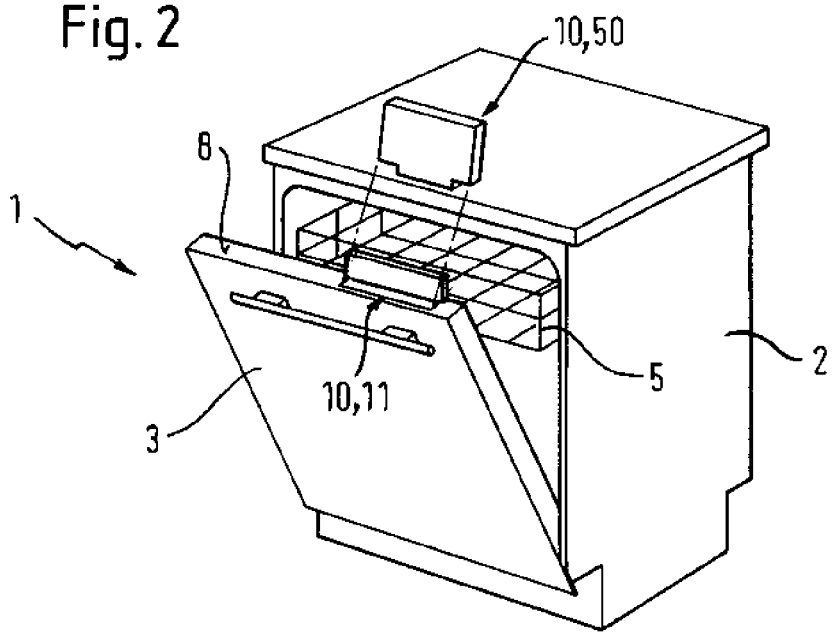
FIG. 2 shows a further dishwasher with a detergent dosing system for receiving a cartridge according to the invention, which is arranged in the door of the dishwasher.

FIG. 2 shows a further dishwasher 1 with a detergent dosing system 10. In contrast to the exemplary embodiment described previously, the detergent dosing system 10, more precisely the detergent dispenser 11, is arranged in the door 3 of the dishwasher. The process of equipping the detergent dispenser 11 with the cartridge 50, which for the rest can be designed in identical manner as described in conjunction with FIG. 3, takes place from the front side 8 of the door. In this situation, the opening for equipping the detergent dispenser 11 can be arranged in the area of a faceplate on the dishwasher or of the inner door of the door. The advantage of the arrangement according to FIG. 2 consists in greater convenience for the user when inserting and removing the cartridge.

What is claimed is:

1. A cartridge for a water-conducting domestic appliance, which has a detergent dosing system having at least one detergent dispenser for receiving the cartridge, wherein the cartridge has at least two chambers for storing at least two detergents, the cartridge consisting of: a cartridge housing having the at least two chambers formed therein, wherein each of the at least two chambers has a storage capacity for storing detergent which is greater than a quantity required for one washing cycle, and means for level measurement of one detergent volume contained in only a single one of the at least two chambers, wherein a size of each of the at least two chambers is dimensioned according to a volume required during a predefined number of washing cycles, and wherein information about a fill level of the single one of the at least two chambers is sufficient in order to deduce a fill level in all of the at least two chambers.

2. The cartridge according to claim 1 wherein the means for level measurement is configured to emit a signal when detergent contained in the cartridge is reduced below a predefined remaining quantity.

3. The cartridge according to claim 2 wherein the means for level measurement is configured to emit a signal when the detergent contained in the cartridge is sufficient for performing a predefined number of washing cycles.

4. The cartridge according to claim 3 wherein the number of washing cycles is between about 2 cycles and about 5 cycles.

5. The cartridge according to claim 1 wherein the means for level measurement is based on at least one of an optical principle of measurement, an acoustic principle of measurement and a capacitive principle of measurement.

6. The cartridge according to claim 1 wherein at least one of the at least two chambers contains at least one ingredient chosen from the group consisting of enzymes, bleaching agents, bleach activators, dispersants and complexing agents, surfactants, alkali carriers and biocides.

* * * * *